US009101974B2

(12) United States Patent
Liang et al.

(10) Patent No.: US 9,101,974 B2
(45) Date of Patent: Aug. 11, 2015

(54) MANUFACTURING METHOD OF AN IRON-TYPE GOLF CLUB HEAD

(75) Inventors: Ming-Ching Liang, Tainan (TW); Chin-Lang Lee, Tainan (TW); Tien-Ken Liang, Tainan (TW)

(73) Assignee: HER CHANG TECHNOLOGY CO., LTD. (TW)

( * ) Notice: Subject to any disclaimer, the term of this patent is extended or adjusted under 35 U.S.C. 154(b) by 724 days.

(21) Appl. No.: 13/473,114

(22) Filed: May 16, 2012

(65) Prior Publication Data

US 2013/0305801 A1 Nov. 21, 2013

(51) Int. Cl.

| | |
|---|---|
| ***B21K 17/00*** | (2006.01) |
| ***B21J 1/00*** | (2006.01) |
| ***A63B 53/04*** | (2015.01) |
| *B21K 23/00* | (2006.01) |

(52) U.S. Cl.

CPC ..... *B21K 17/00* (2013.01); *A63B 53/047* (2013.01); *B21J 1/00* (2013.01); *B21K 23/00* (2013.01)

(58) Field of Classification Search

CPC ..... B21K 17/00; B21K 23/00; A63B 53/047; B21J 1/00

USPC ..... 72/356

See application file for complete search history.

(56) References Cited

U.S. PATENT DOCUMENTS

| | | | | |
|---|---|---|---|---|
| 6,440,011 | B1 * | 8/2002 | Hocknell et al. | 473/342 |
| 8,911,303 | B2 * | 12/2014 | Sakai et al. | 473/350 |
| 2003/0015015 | A1 * | 1/2003 | Takeda | 72/340 |
| 2005/0233825 | A1 * | 10/2005 | Tsai | 473/324 |

* cited by examiner

*Primary Examiner* — Shelley Self
*Assistant Examiner* — Mohammad I Yusuf
(74) *Attorney, Agent, or Firm* — Hershkovitz & Associates, PLLC; Abe Hershkovitz

(57) ABSTRACT

A manufacturing method of an iron-type golf club head has acts of preparing a formed bar-shaped steel substrate, rough-hot forging the bar-shaped steel substrate, mid-hot forging the rough blank, fine-cold forging the mid-blank, cold stamping the striking surface and drilling a hosel of the iron-type golf club head. The cold forging reduces the thermal expansion and contraction of the blank, and the shape of the forged blank is more accurate therefore. As a result, the following grinding processes of the blank are reduced. Therefore, the weight of the blank is more accurate, and the manufacturing time and cost are also reduced. The blank does not have to be heated to high-temperature state prior to cold forging so that the blank can be cooled down faster, and the cost of the heating is reduced.

8 Claims, 2 Drawing Sheets

MANUFACTURING METHOD OF AN IRON-TYPE GOLF CLUB HEAD

BACKGROUND OF THE INVENTION

1. Field of the Invention

The present invention relates to a manufacturing method of an iron-type golf club head, especially to a manufacturing method of an iron-type golf club head that is faster with fewer steps during the manufacturing process, more accurate in the golf club's shape and weight, and lowers the cost.

2. Description of the Prior Arts

The conventional iron-type golf club heads are manufactured by hot forging, and the main steps are shown as below.

First, the carbon steel rod is cut into multiple bar-shaped steel substrates with suitable volume.

Second, the bar-shaped steel substrate is heated by electric furnace to high-temperature state about 1200° C. so that the bar-shaped steel substrate has high plasticity. Then the bar-shaped steel substrate is hot forged and forms a rough blank. After the rough blank is cooled down, the superfluous parts around the rough blank are cut away, and then the rough blank is ground.

Third, the rough blank is heated and is hot forged again. After the rough blank is cooled down, the rough blank forms a mid-blank. Then the mid-blank is ground again.

Fourth, the mid-blank is heated and is hot forged for the third time. After the mid-blank is cooled down, the mid-blank forms a fine blank. Then the fine blank is ground for the third time.

Fifth, a hosel of the fine blank is drilled, and then the fine blank is engraved with the model number of the club.

Sixth, the weight of the fine blank is measured, and the fine blank is ground to adjust the weight of the fine blank.

Seventh, a surface of the fine blank is pressed to form a flat striking surface of a face area. Then the striking surface is pressed to form multiple grooves.

Eighth, an angle of the hosel of the fine blank is adjusted, and then the fine blank is polished manually and by vibration machine in sequence to form a golf club head.

Ninth, the polished golf club head is electroplated, fine tuned, and under sandblasting to form the iron-type golf club head, and the manufacturing process of the iron-type golf club head is accomplished.

However, the conventional manufacturing method of an iron-type golf club head has the following shortcomings.

In the whole manufacturing process, the golf club head is hot forged for multiple times. Each time of the hot forging, the blank is heated to about 1200° C. and the blank is recrystallized. Then the blank needs to be cooled down so as to proceed with the following process such as grinding. Cooling down the blank takes much time.

Furthermore, because the blank is heated and cooled down for many times, the blank expands with heat and contracts at lower temperature, which causes much inaccuracy on the shape and the volume of the blank. Therefore, the blank has to be ground more, which not only takes more time, but also affects the weight and the shape of the blank.

To overcome the shortcomings, the present invention provides a manufacturing method of an iron-type golf club head to mitigate or obviate the aforementioned problems.

SUMMARY OF THE INVENTION

The main objective of the present invention is to provide a manufacturing method of an iron-type golf club head that is faster with fewer steps during the manufacturing process, more accurate in the golf club's shape and weight, and lowers the cost.

The manufacturing method of an iron-type golf club head in accordance with the present invention has acts of preparing a formed bar-shaped steel substrate, rough-hot forging the bar-shaped steel substrate, mid-hot forging the rough blank, fine-cold forging the mid-blank, cold stamping the striking surface and drilling a hosel of the iron-type golf club head. The manufacturing method adopts hot forging followed by cold forging, and adopts the cold forging as the final step of the forging, so it reduces the thermal expansion and contraction of the blank, and the shape of the forged blank is more accurate therefore. Because the shape of the forged blank is more accurate, the following grinding processes of the blank are reduced. As a result, the weight of the blank is more accurate, the manufacturing is faster, and the cost of the working is reduced as well. Compared to blanks made by hot forging, the blank manufactured by the method of the present invention does not have to be heated to high-temperature state of recrystallization prior to cold forging, so that the blank can be cooled down faster, and the cost of the heating is reduced. Besides, the grooves of the striking surface is directly formed by cold stamping, so the manufacturing is more convenient, faster, and the cost is reduced as well. Estimation suggests that the manufacturing method as described increases the capacity by 50%.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
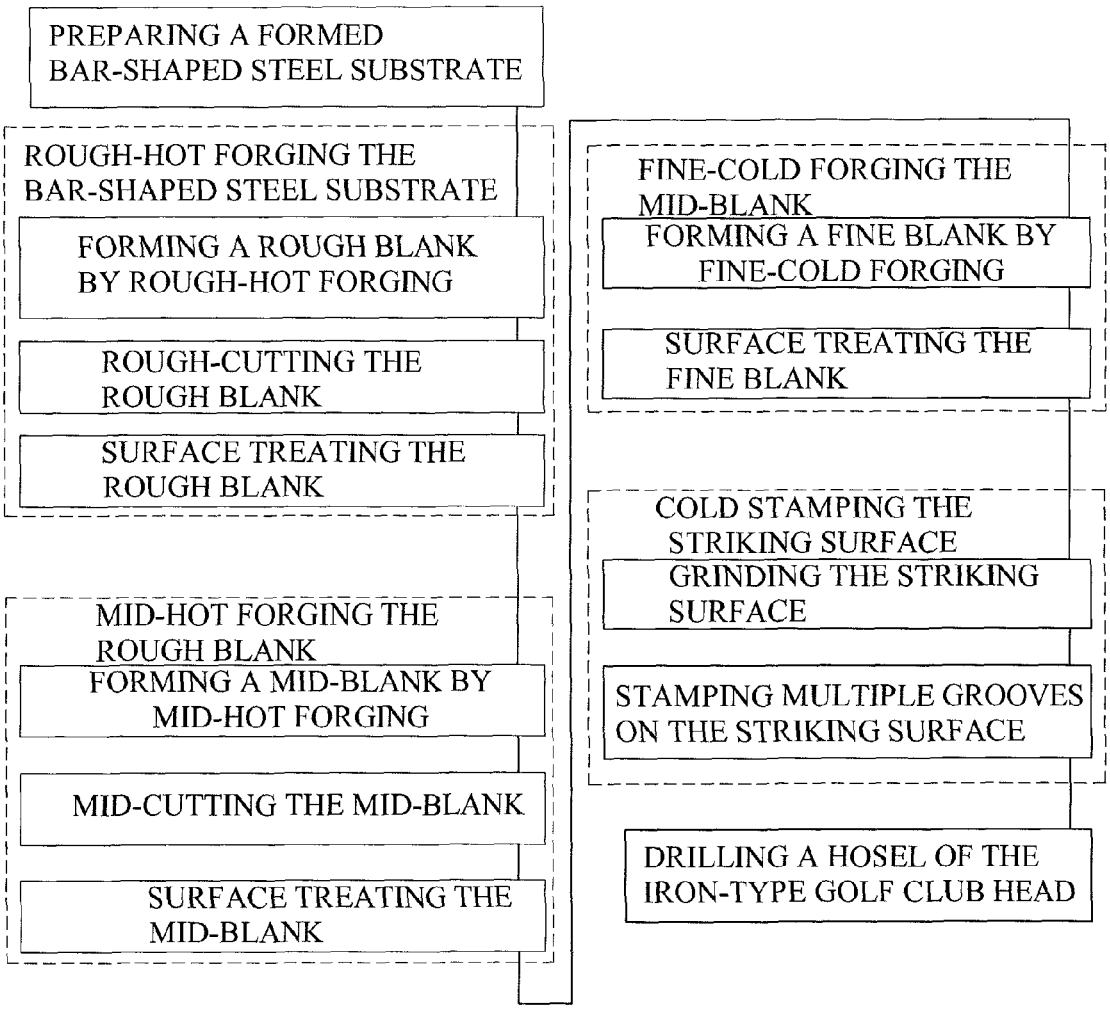
FIG. 1 is a flow chart of a first embodiment of a manufacturing method of an iron-type golf club head in accordance with the present invention.

With reference to FIG. 1, a manufacturing method of an iron-type golf club head in accordance with the present invention comprises acts of preparing a formed bar-shaped steel substrate, rough-hot forging the bar-shaped steel substrate, mid-hot forging the rough blank, fine-cold forging the mid-blank, cold stamping the striking surface and drilling a hosel of the iron-type golf club head.

Preparing a formed bar-shaped steel substrate: a carbon steel rod is cut into multiple bar-shaped steel substrates with suitable volume. Then the bar-shaped steel substrates are bent by machines. The bending force is about 110 tons and is adjustable, depending on the material and the size of the bar-shaped steel substrate.

Rough-hot forging the bar-shaped steel substrate comprises forming a rough blank by rough-hot forging, rough-cutting the rough blank, and surface treating the rough blank.

Forming a rough blank by rough-hot forging: the bar-shaped steel substrate is hot forged and then forms a rough blank in a designed shape. The temperature of the mold of the hot forging is about 830° C. to 880° C., and the compressing force of the hot forging is about 700 tons to 850 tons.

Rough-cutting the rough blank: some superfluous parts around the rough blank are cut away by cutting machine.

Surface treating the rough blank comprises grinding the burrs of the rough blank and sandblasting the rough blank.

Grinding the burrs of the rough blank: the rough blank is ground to remove sharp burrs.

Sandblasting the rough blank: the rough blank is blasted with high pressure by media such as aluminum oxides of 80 mesh to remove oxidized layer caused during rough-hot forging.

Mid-hot forging the rough blank may be a one-phase hot forging, or a two-phase hot forging.

With reference to FIG. 1, mid-hot forging the rough blank as a one-phase forging comprises forming a mid-blank by mid-hot forging, mid-cutting the mid-blank and surface treating the mid-blank.

Forming a mid-blank by mid-hot forging: the rough blank is hot forged and then forms a mid-blank in a designed shape. The temperature of the mold of the hot forging is about 830° C. to 880° C., and the compressing force of the hot forging is about 700 tons to 850 tons.

Mid-cutting the mid-blank: some superfluous parts around the mid-blank are cut away by cutting machine.

Surface treating the mid-blank comprises grinding the burrs of the mid-blank and sandblasting the mid-blank.

Grinding the burrs of the mid-blank: the mid-blank is ground to remove sharp burrs.

Sandblasting the mid-blank: the mid-blank is blasted with high pressure by media such as aluminum oxides of 80 mesh to remove oxidized layer caused during mid-hot forging, and the grinding machine uses abrasive belt with grit #120.

Figure 2:
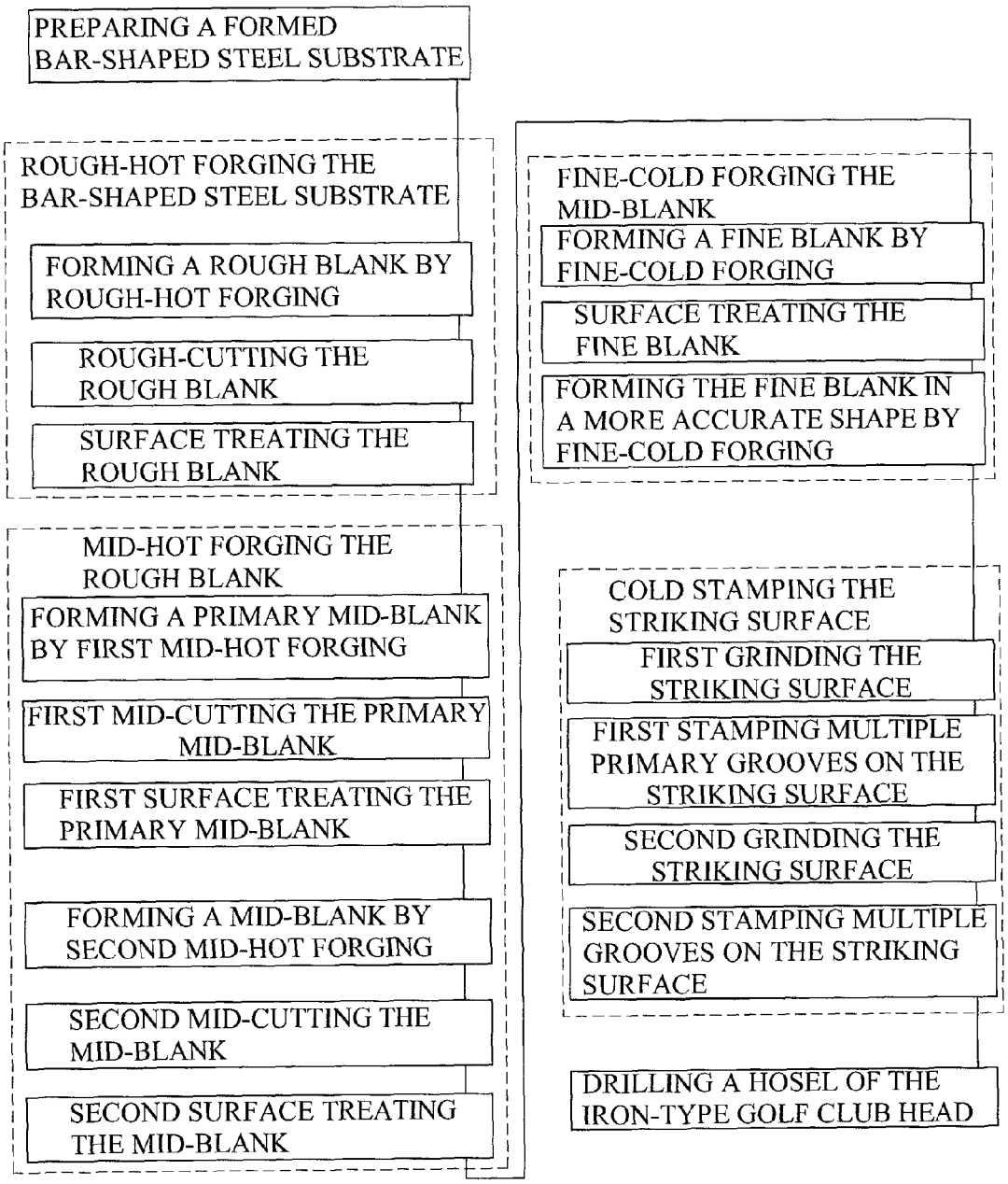
FIG. 2 is a flow chart of a second embodiment of the manufacturing method of an iron-type golf club head in accordance with the present invention.

With reference to FIG. 2, mid-hot forging the rough blank as a two-phase forging comprises forming a primary mid-blank by first mid-hot forging, first mid-cutting the primary mid-blank, first surface treating the primary mid-blank, forming a mid-blank by second mid-hot forging, second mid-cutting the mid-blank and second surface treating the mid-blank.

Forming a primary mid-blank by first mid-hot forging: the rough blank is hot forged and then forms a primary mid-blank in a designed shape. The temperature of the mold of the hot forging is about 830° C. to 880° C., and the compressing force of the hot forging is about 700 tons to 800 tons.

First mid-cutting the primary mid-blank: some superfluous parts around the primary mid-blank are cut away by cutting machine.

First surface treating the primary mid-blank comprises grinding the burrs of the primary mid-blank and sandblasting the primary mid-blank.

Grinding the burrs of the primary mid-blank: the primary mid-blank is ground to remove sharp burrs.

Sandblasting the primary mid-blank: the primary mid-blank is blasted with high pressure by media such as aluminum oxides of 80 mesh to remove oxidized layer caused during first mid-hot forging, and the grinding machine uses abrasive belt with grit #120.

Forming a mid-blank by second mid-hot forging: the primary mid-blank is hot forged and then forms a mid-blank in a designed shape. The temperature of the mold of the hot forging is about 830° C. to 880° C., and the compressing force of the hot forging is about 700 tons to 800 tons.

Second mid-cutting the mid-blank: some superfluous parts around the mid-blank are cut away by cutting machine.

Second surface treating the mid-blank comprises grinding the burrs of the mid-blank and sandblasting the mid-blank.

Grinding the burrs of the mid-blank: the mid-blank is ground to remove sharp burrs.

Sandblasting the mid-blank: the mid-blank is blasted with high pressure mesh such as aluminum oxides of 80 mesh to remove oxidized layer caused during second mid-hot forging, and the grinding machine uses abrasive belt with grit #120.

With reference to FIG. 1, fine-cold forging the mid-blank comprises forming a fine blank by fine-cold forging and surface treating the fine blank.

Forming a fine blank by fine-cold forging: the mid-blank is cold forged at normal ambient temperature and then forms a fine blank in a designed shape. The compressing force of the cold forging is about 700 tons to 800 tons.

Surface treating the fine blank comprises sandblasting the fine blank.

Sandblasting the fine blank: the fine blank is blasted with high pressure by media such as aluminum oxides of 80 mesh.

With reference to FIG. 2, fine-cold forging the mid-blank further comprises forming the fine blank in a more accurate shape by fine-cold forging, which is after surface treating the fine blank.

Forming the fine blank in a more accurate shape by fine-cold forging: the fine blank is further cold forged at normal atmospheric temperature and then is formed in a more accurate shape. The compressing force of the cold forging is about 700 tons to 800 tons.

Cold stamping the striking surface may be a one-phase cold stamping, or a two-phase cold stamping.

With reference to FIG. 1, cold stamping the striking surface as a one-phase cold stamping comprises grinding the striking surface and stamping multiple grooves on the striking surface.

Grinding the striking surface: a striking surface of the fine blank is ground. The grinding machine uses abrasive belt with grit #220 or grit #400.

Stamping multiple grooves on the striking surface: the striking surface is stamped at normal atmospheric temperature to form multiple grooves on the striking surface, and then the fine blank forms an iron-type golf club head. The force of the stamping is about 400 tons to 500 tons.

With reference to FIG. 2, cold stamping the striking surface as a two-phase cold stamping comprises first grinding the striking surface, first stamping multiple primary grooves on the striking surface, second grinding the striking surface and second stamping multiple grooves on the striking surface.

First grinding the striking surface: a striking surface of the fine blank is ground. The grinding machine uses abrasive belt with grit #220 or grit #400.

First stamping multiple primary grooves on the striking surface: the striking surface is stamped at normal atmospheric temperature to form multiple primary grooves on the striking surface. The force of the stamping is about 450 tons to 550 tons.

Second grinding the striking surface: the striking surface is ground. The grinding machine uses abrasive belt with grit #220 or grit #400.

Second stamping multiple grooves on the striking surface: the striking surface is stamped at normal atmospheric temperature to form multiple grooves on the striking surface, and then the fine blank forms an iron-type golf club head. The force of the stamping is about 450 tons to 550 tons.

Drilling a hosel of the iron-type golf club head: the hosel of the iron-type golf club head is drilled by drill machine, such that the iron-type golf club head can be mounted securely on shaft to form an iron-type golf club.

With the aforementioned description, the manufacturing method of an iron-type golf club head as described has the following advantages.

1. The manufacturing method as described adopts hot forging followed by cold forging, and adopts the cold forging as the final step of the forging, so that the manufacturing method as described effectively reduces the thermal expansion and contraction of the blank. As a result, the shape of the forged blank is more accurate after each forging, and the blank is easier to be proceeded with the surface treating such as grinding. Then the shape of the final product of the iron-type golf club head is more accurate, and the manufacturing method as described reduces the impacts of shape inaccuracy on the iron-type golf club head striking.

2. As aforementioned, the manufacturing method as described adopts hot forging followed by cold forging so that the shape of the iron-type golf club head is more accurate. As a result, the surface treating processes of the iron-type golf club head are reduced. The variation and inaccuracy of the shape of the iron-type golf club head after the surface treating are also reduced. Then the weight of the iron-type golf club head is stable and is easier to be controlled.

3. As aforementioned, the manufacturing method as described adopts hot forging followed by cold forging to reduce the time in heating to high-temperature state of recrystallization during cold forging. Then the cost of the heating is reduced, and the variation of the shape by the thermal expansion and contraction of the blank is reduced. Therefore, the following grinding is also reduced, and the cost of the grinding process is reduced as well. As a result, the manufacturing method as described lowers the cost.

4. The grooves of the striking surface are directly formed by cold stamping. The cold stamping is more convenient, faster, and reduces the cost as well.

5. As aforementioned, the manufacturing method as described effectively reduces the manufacturing time. The manufacturing method as described increases the capacity by 50% relative to the conventional manufacturing method so that the manufacturing method as described effectively enhances the product competitiveness.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A manufacturing method of an iron-type golf club head comprising acts of:

(a) preparing a formed bar-shaped steel substrate;

(b) rough-hot forging the bar-shaped steel substrate comprising:

(b1) forming a rough blank by rough-hot forging comprising hot forging the bar-shaped steel substrate to form a rough blank in a designed shape;

(b2) rough-cutting the rough blank comprising cutting away superfluous parts around the rough blank; and (b3) surface treating the rough blank;

(c) mid-hot forging the rough blank comprising:

(c1) forming a mid-blank by mid-hot forging comprising hot forging the rough blank to form a mid-blank in a designed shape;

(c2) mid-cutting the mid-blank comprising cutting away superfluous parts around the mid-blank; and (c3) surface treating the mid-blank;

(d) fine-cold forging the mid-blank comprising:

(d1) forming a fine blank by fine-cold forging comprising cold forging the mid-blank to form a fine blank in a designed shape; and (d2) surface treating the fine blank;

(e) cold stamping the striking surface comprising:

(e1) grinding the striking surface comprising grinding a striking surface of the fine blank; and (e2) stamping multiple grooves on the striking surface comprising cold stamping the striking surface to form multiple grooves on the striking surface and to form an iron-type golf club head; and (f) drilling a hosel of the iron-type golf club head.

2. The manufacturing method of an iron-type golf club head as claimed in claim 1, wherein (b3) surface treating the rough blank further comprises:

(b32) grinding the burrs of the rough blank comprising grinding the rough blank to remove sharp burrs; and (b32) sandblasting the rough blank comprising blasting the rough blank with high pressure by sands to remove oxidized layer caused during rough-hot forging;

(c3) surface treating the mid-blank further comprises:

(c31) grinding the burrs of the mid-blank comprising grinding the mid-blank to remove sharp burrs; and (c32) sandblasting the mid-blank comprising blasting the mid-blank with high pressure by sands to remove oxidized layer caused during mid-hot forging; and (d2) surface treating the fine blank further comprises:

(d21) sandblasting the fine blank comprising blasting the fine blank with high pressure by sands.

3. The manufacturing method of an iron-type golf club head as claimed in claim 1 further comprising a step (d3) forming the fine blank in a more accurate shape by fine-cold forging, which is after the step (d2) of surface treating the fine blank, wherein (d3) forming the fine blank in a more accurate shape by fine-cold forging comprises further cold forging the fine blank to form the fine blank in a more accurate shape.

4. The manufacturing method of an iron-type golf club head as claimed in claim 2 further comprising a step (d3) forming the fine blank in a more accurate shape by fine-cold forging, which is after the step (d2) of surface treating the fine blank, wherein (d3) forming the fine blank in a more accurate shape by fine-cold forging comprises further cold forging the fine blank to form the fine blank in a more accurate shape.

5. A manufacturing method of an iron-type golf club head comprising acts of:

(a) preparing a formed bar-shaped steel substrate;

(b) rough-hot forging the bar-shaped steel substrate comprising:

(b1) forming a rough blank by rough-hot forging comprising hot forging the bar-shaped steel substrate to form a rough blank in a designed shape;

(b2) rough-cutting the rough blank comprising cutting away superfluous parts around the rough blank; and (b3) surface treating the rough blank;

(c) mid-hot forging the rough blank comprising:

(c1) forming a primary mid-blank by first mid-hot forging comprising hot forging the rough blank to form a primary mid-blank in a designed shape;

(c2) first mid-cutting the primary mid-blank comprising cutting away superfluous parts around the primary mid-blank;

(c3) first surface treating the primary mid-blank;

(c4) forming a mid-blank by second mid-hot forging comprising hot forging the primary mid-blank to form a mid-blank in a designed shape;

(c5) second mid-cutting the mid-blank comprising cutting away superfluous parts around the mid-blank; and (c6) second surface treating the mid-blank;

(d) fine-cold forging the mid-blank comprising:

(d1) forming a fine blank by fine-cold forging comprising cold forging the mid-blank to form a fine blank in a designed shape; and (d2) surface treating the fine blank;

(e) cold stamping the striking surface comprising:

(e1) first grinding the striking surface comprising grinding a striking surface of the fine blank;

(e2) first stamping multiple primary grooves on the striking surface comprising cold stamping the striking surface to form multiple primary grooves on the striking surface;

(e3) second grinding the striking surface comprising grinding the striking surface; and (e4) second stamping multiple grooves on the striking surface comprising cold stamping the striking surface to multiple grooves on the striking surface, and to form an iron-type golf club head; and (f) drilling a hosel of the iron-type golf club head.

6. The manufacturing method of an iron-type golf club head as claimed in claim 5, wherein (b3) surface treating the rough blank further comprises:

(b31) grinding the burrs of the rough blank comprising grinding the rough blank to remove sharp burrs; and (b32) sandblasting the rough blank comprising blasting the rough blank with high pressure by sands to remove oxidized layer caused during rough-hot forging;

(c3) first surface treating the primary mid-blank further comprises:

(c31) grinding the burrs of the primary mid-blank comprising grinding the primary mid-blank to remove sharp burrs; and (c32) sandblasting the primary mid-blank comprising blasting the primary mid-blank with high pressure by sands to remove oxidized layer caused during first mid-hot forging;

(c6) second surface treating the mid-blank further comprises:

(c61) grinding the burrs of the mid-blank comprising grinding the mid-blank to remove sharp burrs; and (c62) sandblasting the mid-blank comprising blasting the mid-blank with high pressure by sands to remove oxidized layer caused during second mid-hot forging; and (d2) surface treating the fine blank further comprises:

(d21) sandblasting the fine blank comprising blasting the fine blank with high pressure by sands.

7. The manufacturing method of an iron-type golf club head as claimed in claim 5 further comprising a step (d3) forming the fine blank in a more accurate shape by fine-cold forging, which is after the step (d2) of surface treating the fine blank, wherein (d3) forming the fine blank in a more accurate shape by fine-cold forging comprises further cold forging the fine blank to form the fine blank in a more accurate shape.

8. The manufacturing method of an iron-type golf club head as claimed in claim 6 further comprising a step (d3) forming the fine blank in a more accurate shape by fine-cold forging, which is after the step (d2) of surface treating the fine blank, wherein (d3) forming the fine blank in a more accurate shape by fine-cold forging comprises further cold forging the fine blank to form the fine blank in a more accurate shape.

* * * * *